US011542584B2

(12) United States Patent
Cao et al.

(10) Patent No.: US 11,542,584 B2
(45) Date of Patent: Jan. 3, 2023

(54) METHOD AND APPARATUS FOR ENVIRONMENTALLY-FRIENDLY BATCH HOT-DIP COATING OF HIGH-PERFORMANCE ALLOY

(71) Applicant: TIANJIN GONGDA GALVANIZING EQUIPMENT CO., LTD., Tianjin (CN)

(72) Inventors: Xiaoming Cao, Tianjin (CN); Ruina Ma, Tianjin (CN); Yongzhe Fan, Tianjin (CN); Zongcai Zhou, Tianjin (CN); Lin Ma, Tianjin (CN)

(73) Assignee: TIANJIN GONGDA GALVANIZING EQUIPMENT CO., LTD., Tianjin (CN)

( * ) Notice: Subject to any disclaimer, the term of this patent is extended or adjusted under 35 U.S.C. 154(b) by 0 days.

(21) Appl. No.: 17/093,659

(22) Filed: Nov. 10, 2020

(65) Prior Publication Data

US 2021/0198781 A1 Jul. 1, 2021

(30) Foreign Application Priority Data

Dec. 28, 2019 (CN) ..... 201911384613.9

(51) Int. Cl.
*C23C 2/06* (2006.01)
*C23C 2/02* (2006.01)

(52) U.S. Cl.
CPC . *C23C 2/06* (2013.01); *C23C 2/02* (2013.01)

(58) Field of Classification Search
CPC .. C23C 2/06; C23C 2/02; C23C 2/405; C23C 2/003
See application file for complete search history.

(56) References Cited

U.S. PATENT DOCUMENTS 4,814,210 A * 3/1989 Ackermann ..... C23C 2/385 427/433

FOREIGN PATENT DOCUMENTS

| | | | | |
|---|---|---|---|---|
| CN | 201915140 U | * | 8/2011 | ..... C23C 2/06 |
| CN | 104404422 B | * | 5/2017 | ..... C23C 2/003 |
| CN | 108220854 A | * | 6/2018 | ..... C23C 2/003 |
| CN | 110202138 A | * | 9/2019 | ..... B22F 10/00 |

* cited by examiner

*Primary Examiner* — Hai Y Zhang
(74) *Attorney, Agent, or Firm* — Bayramoglu Law Offices LLC

(57) ABSTRACT

A method and an apparatus for environmentally-friendly batch hot-dip coating of high-performance alloy are provided. The method is that workpiece is heated to the process temperature in the heating box with inner gas before galvanizing. The heating box body consist of two or three zones, which are waiting zone, heating zone and post-plating turnover zone (the post-plating turnover zone can be omitted). A zinc pot is arranged in the heating zone, and the zinc pot is configured for hot-dip coating. Workpieces can be processed with zinc or zinc-based alloys. A transporting device is configured to successively transport in a sealed state the workpiece to be processed to the waiting zone, the heating zone, the zinc pot, and the post-plating turnover zone (the post-plating turnover zone can be omitted). The new method realizes hot-dip coating with zinc and other zinc-based alloys without the use of the flux.

7 Claims, 2 Drawing Sheets

METHOD AND APPARATUS FOR ENVIRONMENTALLY-FRIENDLY BATCH HOT-DIP COATING OF HIGH-PERFORMANCE ALLOY

CROSS REFERENCE TO THE RELATED APPLICATIONS

This application is based upon and claims priority to Chinese Patent Application No. 201911384613.9, filed on Dec. 28, 2019, the entire contents of which are incorporated herein by reference.

TECHNICAL FIELD

The present invention relates to the technical field of hot-dip galvanizing, and in particular, to a method and an apparatus for environmentally-friendly batch hot-dip coating of high-performance alloy.

BACKGROUND

Batch hot-dip galvanizing refers to plating a metal onto a batch of steel components and products with different shapes arranged on a rack. The steel components include steel structural parts, guardrail plates, steel pipes, electric power fittings, fasteners and various miscellaneous parts. Currently, flux method (also called dry method) is mainly used for batch hot-dip galvanizing. The flux method is performed after rust is removed from the surface of a workpiece, and includes dipping the workpiece in a zinc ammonia type flux and drying. The traditional process is as follows: rust removal—water washing—flux—drying—hot-dip galvanizing—post-treatment. The principle of the flux method is that a zinc-iron reaction occurs on the surface of clean metal to realize the hot-dip galvanizing. The surfaces of the steel components are cleaned and dipped with the flux to protect them from rusting again. The clean metal surface is freshly exposed after the protective film of the flux is ruptured under heat during zinc coating. The above-mentioned flux method has the following disadvantages:

1. Environmental pollution: a large amount of zinc smoke is produced when the flux reacts with the high-temperature zinc bath on the surface of the workpiece. A large amount of zinc ash is also formed at the same time, resulting in an increased use of zinc, which adds expense to the process and further harm to the environment.

2. Low production efficiency: substantial time is necessary for the workpiece to be dried and heated to the process temperature for hot-dip plating. Production efficiency is essentially "capped" as a result.

3. High production cost: the flux method employs an open system for heating, and therefore, heat dissipation from the zinc pot surface causes substantial energy loss. In addition, the workpiece is heated in a zinc bath and, therefore, the workpiece must be immersed in the zinc pot for an extended period, resulting in overreaction of zinc with iron producing zinc dross. The flux oxidizes on the metal surface to produce zinc ash as well, which requires that zinc resources be replenished. Therefore, high energy consumption and high zinc consumption add substantially to production cost, decrease profits and decrease competitiveness for zinc hot-dip galvanizing.

4. The existing flux method for hot-dip galvanizing can coat workpieces only with zinc, but cannot coat workpieces with other zinc-based alloys.

SUMMARY

The objective of the present invention is to provide a method and an apparatus for environmentally-friendly batch hot-dip coating of high-performance alloy, which realizes hot-dip zinc coating and other zinc-based alloys without flux avoids zinc smoke pollution, improves production efficiency and reduces production cost.

To achieve the objective, the present invention adopts the following technical solutions.

An apparatus for environmentally-friendly batch hot-dip coating of high-performance alloy, including:

a waiting zone, in which a first confined space is arranged in the waiting zone. The first confined space is filled with inert gas;

a heating zone, in which the heating zone is arranged downstream of the waiting zone. A second confined space is arranged in the heating zone and the second confined space is filled with inert gas. The second confined space is selectively connected to the first confined space. The second confined space is arranged with a heating device, and the heating device is configured for heating a workpiece to be processed;

a post-plating turnover zone, in which the post-plating turnover zone is arranged downstream of the heating zone. A third confined space is arranged in the post-plating turnover zone, and the third confined space is selectively connected to the second confined space;

a zinc pot, in which the zinc pot is arranged in the heating zone, and the zinc pot is configured for hot-dip plating zinc or zinc-based alloys on the workpiece to be processed; and a transporting device, in which the transporting device is configured to successively transport in a sealed state the workpiece to be processed to the waiting zone, the heating zone, the zinc pot, and the post-plating turnover zone.

As an optimization, the apparatus further includes a box body, in which the box body forms the waiting zone, the heating zone and the post-plating turnover zone successively along the length direction. Or the box body forms the waiting zone and the heating zone successively along the length direction As an optimization, sealing doors are arranged between the waiting zone and the heating zone, and between the heating zone and the post-plating turnover zone, respectively. If there is no the post-plating turnover zone, then the sealing door between the heating zone and the post-plating turnover zone can be omitted.

As an optimization, at least one side of the sealing door is provided with a linear air knife, and the linear air knife is configured to form a nitrogen curtain before the sealing door is opened to seal the side of the sealing door.

As an optimization, the transporting device includes a first crown block arranged above the box body, and the hoisting structure of the first crown block hermetically extends into the box body for hoisting and transporting the workpiece to be processed.

As an optimization, the top of the box body is provided with a walking groove along its length direction. The walking groove covers the first confined space, the second confined space and the third confined space, and the hoisting structure of the first crown block hermetically extends into the box body through the walking groove.

As an optimization, the apparatus further includes an organ sealing cover, in which the organ sealing cover is arranged on the walking groove. The hoisting structure of the first crown block hermetically passes through the organ sealing cover and is placed in the box body, and the first crown block moves to drive the organ sealing cover to extend and shrink.

As an optimization, an oil groove is arranged at a periphery of the walking groove, and the bottom of the organ sealing cover is placed in the oil groove and sealed by the liquid in the oil groove.

As an optimization, the heating device is arranged on the inner wall of the heating zone and is located above the zinc pot.

The present invention also provides a method for environmentally-friendly batch hot-dip coating of high-performance alloy, which is applied to the above-mentioned apparatus for environmentally-friendly batch hot-dip plating of high-performance alloy, and includes:

transporting a pre-treated workpiece to be processed to the waiting zone, and hoisting the workpiece to be processed through the transporting device, in which a pre-treatment includes rust removal and/or water washing;

filling the inert gas with a preset purity into the waiting zone;

transporting the workpiece to be processed to the heating zone by the transporting device, and heating to a preset temperature by the heating device in the heating zone;

hoisting the workpiece to be processed into the zinc pot by the transporting device for hot-dip plating with zinc or zinc-based alloy;

transporting the workpiece to be processed after being hot-dip coated with zinc or zinc-based alloy to the post-plating turnover zone by the transporting device.

The advantages of the present invention are as follows. Oxidation of the workpiece to be processed is avoided by transporting the workpiece to be processed to the waiting zone filled with the inert gas. Subsequently, the workpiece is conveyed to the heating zone filled with the inert gas, so that the high-energy surface is obtained by heating (i.e., directly heating the workpiece to be processed) while further preventing it from oxidation, which provides the energy required for intense zinc-iron reaction to implement the hot-dip plating, thereby avoiding the occurrence of skip plating. Next, the workpiece is directly placed into the zinc pot for zinc coating. No reaction during the zinc coating occurs between the flux and the surfaces of steel components because there is no use of flux. No other chemical substances are involved in the reaction. As a result, the coating layer is clean and smooth, with good quality, and no zinc smoke pollution. Additionally, since the second confined space is arranged in the heating zone, there is no zinc ash and less zinc dross during the reaction process, thus greatly reducing the cost of zinc coating.

Moreover, the process of the present invention does not use flux, and realizes hot-dip coating of other zinc-based alloys besides zinc, such as Galfan (zinc-5% aluminum-rare earth alloy), Galvalume (composed of zinc, 55% aluminum and silicon), zinc-aluminum-magnesium, zinc-aluminum-silicon, zinc-nickel and other alloys, so as to solve the problem that an existing workpiece to be processed cannot be hot-dip coated with the alloys.

Additionally, the present invention realizes batch hot-dip zinc coating or zinc-based alloy on the workpiece to be processed, so as to improve the production efficiency and reduce the production cost.

Figure 1:
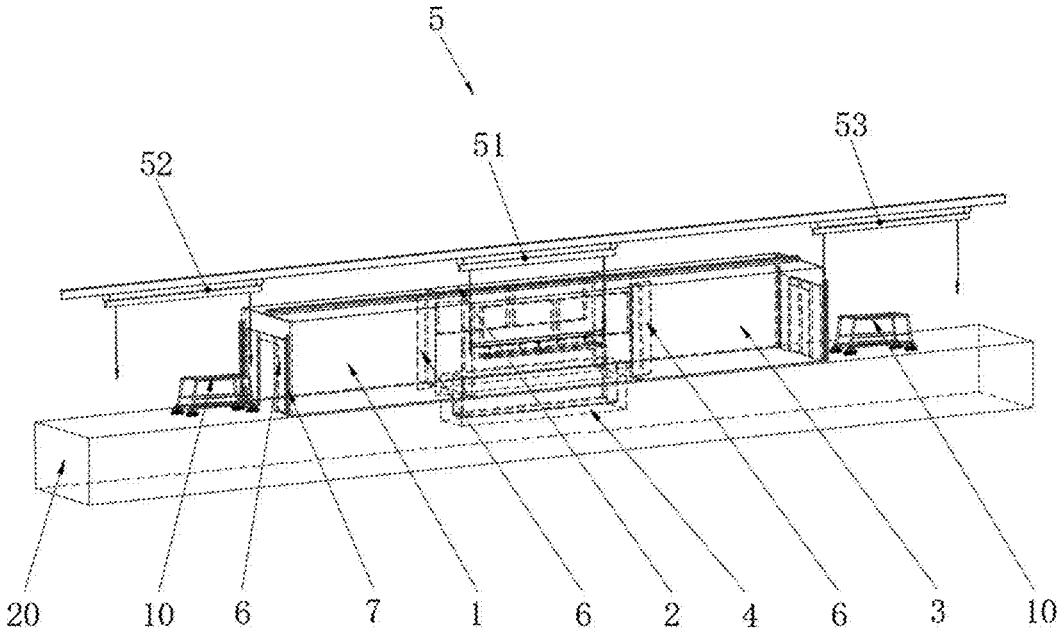
FIG. 1 is a structural diagram showing the apparatus for environmentally-friendly batch hot-dip coating of high-performance alloy according to the present invention.

1. waiting zone; 2. heating zone; 3. post-plating turnover zone; 4. zinc pot; 5. transporting device; 51. first crown block; 52. second crown block; 53. third crown block; 6. sealing door; 7. linear air knife; 8. organ sealing cover; 9. oil groove; 10. trolley; 20. loading platform.

DETAILED DESCRIPTION OF THE EMBODIMENTS

The present invention will be further described in detail with reference to the drawings and embodiments. It is understood that the specific embodiments described herein are only used to explain the present invention and not to limit the present invention. In addition, it should be noted that for the convenience of description, only parts of structures related to the present invention rather than all are shown in the drawings.

In the description of the present invention, the terms "link", "connect" and "fix", unless expressly stated and defined otherwise, are to be understood in a broad sense. For example, it may be a fixed connection, a detachable connection, or an integral connection; it may be a mechanical connection, or an electrical connection; it may be a direct connection, or an indirect connection via an intermediate medium; it may be a communication between two components or an interaction of the two components. For those of ordinary skill in the art, the specific meaning of the above-mentioned terms in the present invention can be understood in specific circumstances.

In the present invention, unless expressly stated and defined otherwise, a first feature located "above" or "below" a second feature may include the first feature directly contact the second feature, or may include the first feature is connected to the second feature through another feature arranged therebetween instead of direct contact. Moreover, the first feature is "on top of" "upward side" and "above" the second feature, which means that the first feature is directly above and obliquely above the second feature, or simply indicates that the first feature is higher in horizontal height than the second feature. The first feature is "under", "underneath" and "below" the second feature, which means that the first feature is directly below and obliquely below the second feature, or simply indicates that the first feature is lower in horizontal height than the second feature.

In the description of the embodiments, the terms "up", "down", "right" and other orientation or position relations are based on the orientation or position relations shown in the drawings, which are only for the convenient description and simply operation, rather than indicating or implying that the device or component must have a specific orientation, be constructed and operated in a specific orientation, and therefore cannot be understood as a limitation of the present invention. In addition, the terms "first" and "second" are only used to distinguish one from another and have no particular meaning.

The present invention provides an apparatus for environmentally-friendly batch hot-dip coating of high-performance alloy, which realizes hot-dip zinc coating and other zinc-based alloys on a workpiece to be processed without the use of flux, and also realizes batch hot-dip coating on the workpiece to be processed. As shown in FIG. 1, the apparatus includes the waiting zone 1, the heating zone 2 and the post-plating turnover zone 3 successively arranged along the transporting direction of the workpiece to be processed. A heating device (not shown in the figure) and the zinc pot 4 are also arranged in the heating zone 2. The transporting device 5 is arranged above the waiting zone 1, the heating zone 2 and the post-plating turnover zone 3, and the transporting device 5 conveys the workpiece to be processed. The trolley 10 is arranged at the upstream position of the waiting zone 1, and the workpiece to be processed is placed on the trolley 10 and transported into the waiting zone 1. The trolley 10 may also be arranged at the downstream of the post-plating turnover zone 3, the trolley 10 is configured to support the workpiece to be processed after the hot-dip plating, and the trolley 10 transports the workpiece to be processed after the hot-dip plating in the post-plating turnover zone 3.

As shown in FIG. 1, the apparatus also includes the loading platform 20. The waiting zone 1, the heating zone 2, the post-plating turnover zone 3, the zinc pot 4, the transporting device 5 and the trolley 10 are all placed on the loading platform 20.

The first confined space is arranged in the waiting zone 1, specifically, the waiting zone 1 can be regarded as an independent box body with the first confined space inside. An air filling device (not shown) is arranged on the waiting zone 1, and the air filling device fills the inert gas with the preset purity into the first confined space. After the workpiece to be processed is transported to the first confined space of the waiting zone 1 by the trolley 10, the workpiece will not be oxidated due to the filled inert gas. Nitrogen or argon is preferred for the inert gas, and nitrogen is more preferred because it is less expensive.

In this embodiment, the sealing door 6 is arranged on both sides of the waiting zone 1, and in particular on the side close to the trolley 10 and on the side adjacent to the heating zone 2. The first confined space is sealed by the sealing door 6. More preferably, the sealing door 6 on the side, close to the trolley 10, of the waiting zone 1 is a sliding door, and the operator can close the side of the waiting zone 1 by pushing and pulling the sliding door. The sealing door 6 on the side, adjacent to the heating zone 2, of the waiting zone 1 is an opening-closing door (i.e. a door with two separate door bodies capable of opening and closing to realize the door opening and closing), and the opening-closing door is driven by a pneumatic arm to open and close towards the inner side of the waiting zone 1. The reason why the sealing door 6 on this side is configured as the opening-closing door is the sealing between the waiting zone 1 and the heating zone 2 is inconvenient for the operator to operate. On the other hand, the opening-closing door is automatically driven by the pneumatic arm to open and close, so the operation is more convenient.

Further, in order to avoid external air entering the waiting zone 1 when the sealing door 6 on the side, close to the trolley 10, of the waiting zone 1 is opened, the linear air knife 7 is arranged on this side of the waiting zone 1, and the linear air knife 7 is arranged on the outside of the sealing door 6. The nitrogen curtain is formed when the linear air knife 7 is opened to seal the open part of the sealing door 6, which forms the nitrogen gate seal structure. The nitrogen gate seal structure effectively avoids the entry of the external air, and further avoids the oxidation of the workpiece to be processed due to the entry of the external air. Of course, in this embodiment, the linear air knife 7 may be arranged on the side, adjacent to the heating zone 2, of the waiting zone 1, so as to further improve the sealing performance of the first confined space, and also prevent the inert gas in the waiting zone 1 from flowing into the heating zone 2 that causing insufficient purity of the inert gas in the waiting zone 1.

The heating zone 2 is configured for heating and hot-dip plating the workpiece to be processed. Alternatively, the heating zone 2 can be regarded as an independent box body adjacent to the waiting zone 1. The second confined space is arranged inside the heating zone 2, an air filling device (not shown in the figure) is arranged on the heating zone 2, and the air filling device fills the inert gas with the preset purity into the second confined space to avoid oxidation of the workpiece to be processed.

In this embodiment, the sealing door 6 may also be arranged on both sides of the heating zone 2, which achieves the sealing of the second confined space. Preferably, the sealing doors 6 on both sides of the heating zone 2 are opening-closing doors. Further, in order to simplify the structure and reduce the processing cost, the sealing door 6 is shared by the waiting zone 1 and the heating zone 2 on the sides adjacent to each other, that is, only one sealing door 6 is arranged on the waiting zone 1 or the heating zone 2. Accordingly, the linear air knife 7 is arranged based on the above-mentioned structure and shared by the waiting zone 1 and the heating zone 2. Preferably, the sealing doors 6 on both sides of the heating zone 2 are provided with the heat insulation layer to further prevent the heat in the heating zone 2 from radiating from both sides, thus ensuring the temperature in the heating zone 2.

In this embodiment, the heating device is arranged in the heating zone 2, and the heating device is configured to heat the workpiece to be processed from the waiting zone 1 to reach the preset temperature. Alternatively, the heating device of the present embodiment may adopt the resistance heating principle, and adopt the far-infrared resistance heating structure in order to improve the heating efficiency. Alternatively, the heating device adopts the natural gas heating principle, such as using the radiation tube heating structure. The heating device may also adopt other structures that can realize heating. Preferably, the heating device is arranged on the inner wall of the heating zone 2, and the heating device may be arranged in the way of surrounding the circumferential inner wall, top wall and bottom wall of the heating zone 2, so as to uniformly heat the surface of the workpiece to be processed.

It should be noted that the higher the temperature is, the more intensive the metal interface reaction is. Under the high temperature, hot-dip plating poses reduced requirement on the surface cleanliness of the workpiece to be processed. In this embodiment, the workpiece to be processed is heated in the heating zone 2 filled with inert gas, which, on one hand, further avoids oxidation during heating, and on the other hand, obtains the high-energy surface. As a result, the energy required for a complete zinc-iron reaction to implement the hot-dip plating is provided, thereby avoiding the occurrence of skip plating. In addition, the present embodiment further provides the independent heating zone 2, so that the workpiece to be processed is heated only in the second confined space. On the one hand, the workpiece to be processed is quickly heated to the preset temperature due to the small volume of the second confined space in the heating process, and on the other hand, the workpiece to be processed is heated uniformly and quickly during the heating process, so as to improve the hot-dip plating effect during subsequent hot-dip plating.

In this embodiment, the zinc pot 4 is placed in the heating zone 2 and the zinc pot 4 is placed on the loading platform 20. The heated flux is placed in the zinc pot 4 (the temperature of the flux is generally required to be between (the melting point of the flux+20)° C.-700° C., depending on the workpiece to be processed). The workpiece to be processed (heating temperature is 400° C.-700° C.) after heated by the heating device is directly put into the zinc pot 4. The surface of the workpiece to be processed reacts directly with the flux to form a coating layer, and there is no need for chemical substances, such as fluxes to participate in the reaction because the surface of the workpiece to be processed will not be oxidized in the inert gas environment. The formed coating layer is clean and smooth with better quality. Additionally, the above-mentioned flux of this embodiment is zinc bath or any other zinc-based alloys, such as Galfan (zinc-5% aluminum-rare earth alloy), Galvalume (composed of zinc, aluminum and silicon), zinc-aluminum-magnesium, zinc-aluminum-silicon, zinc-nickel, so as to solve the problem that the existing workpiece to be processed cannot be hot-dip plated with the alloys.

In this embodiment, the workpiece to be processed is heated by the heating device outside the zinc pot 4, and it is not needed to soak the workpiece to be processed for a long time, thus avoiding the excessive reaction of zinc and iron, avoiding the large amount of produced zinc dross, reducing the zinc consumption and reducing the production cost.

In this embodiment, it needs to be pointed out that in order to obtain the required thickness of the coating layer, the hot-dip plating is performed for several times in the heating zone 2 to obtain the required thickness of the coating layer.

The post-plating turnover zone 3 is arranged downstream of the heating zone 2. The post-plating turnover zone 3 is configured to place the workpiece to be processed after the hot-dip plating. Exemplarily, the post-plating turnover zone 3 is regarded as an independent box body, and the third confined space is arranged in the post-plating turnover zone 3. The third confined space communicates with the second confined space of the heating zone 2. The sealing door 6 is arranged on both sides of the post-plating turnover zone 3, specifically on the side close to the trolley 10 and the side adjacent to the heating zone 2. The third confined space is sealed by the sealing door 6. In this embodiment, the sealing door 6 on the side, adjacent to the trolley 10, of the turnover zone 3 is a sliding door, and the operator closes the side of the post-plating turnover zone 3 by pushing and pulling the sealing door 6. The sealing door 6 on the side, adjacent to the heating zone 2, of the post-plating turnover zone 3 is an opening-closing door. The opening-closing door is driven by a pneumatic arm to open and close towards the inner side of the post-plating turnover zone 3. In addition, in order to save the cost and simplify the structure, the sealing door 6 is shared the post-plating turnover zone 3 and the heating zone 2 on the sides adjacent to each other, that is, only one sealing door 6 is arranged on the post-plating turnover zone 3 or the heating zone 2.

In this embodiment, the heat insulation layer is arranged at the sealing door 6 on both sides of the heating zone 2, and the heat insulation layer further ensures that the heat in the heating zone 2 is not lost.

In this embodiment, the linear air knife 7 is arranged at the side, adjacent to the heating zone 2, of the post-plating turnover zone 3. Before the sealing door 6, which is shared by the post-plating turnover zone 3 and the heating zone 2 on the sides adjacent to each other, is opened, the nitrogen gate seal is formed by the linear air knife 7 to seal the second confined space of the heating zone 2, so as to prevent the inert gas in the heating zone 2 from entering into the post-plating turnover zone 3, at the same time, to prevent the air in the post-plating turnover zone 3 from entering into the heating zone 2. In addition, the nitrogen gate seal keeps the temperature in the heating zone 2 and further reduces the energy consumption. Additionally, the linear air knife 7 is arranged on the side, adjacent to the trolley 10, of the post-plating turnover zone 3 in this embodiment.

In this embodiment, preferably, the waiting zone 1, the heating zone 2 and the post-plating turnover zone 3 is formed by a box body, that is, a box body is arranged on the loading platform 20. The box body is divided into three zones by the sealing doors 6, i.e., the waiting zone 1, the heating zone 2, and the post-plating turnover zone 3. The three zones are formed by the box body, which better ensures the sealing performance, makes the hot-dip plating be in a closed environment, and then prevents the surface of the workpiece to be processed from being oxidized with the cooperation of the inert gas environment and the sealing doors 6, to realize the hot-dip plating better.

The transporting device 5 is arranged above the box body. Exemplarily, the transporting device 5 includes the first crown block 51. The first crown block 51 is provided with a hoisting structure, and the hoisting structure hermetically extends into the box body for hoisting and transporting the workpiece to be processed. The hoisting structure hoists the workpiece to be processed into the zinc pot 4. It should be noted that the hoisting structure realizes the batch hoisting of the workpiece to be processed, and therefore, the batch hot-dip coating of the workpiece to be processed is achieved.

Further, in this embodiment, the top of the box body is provided with a walking groove along its length direction, and the walking groove extends from the waiting zone 1 to the post-plating turnover zone 3. Besides, the walking groove covers the first confined space, the second confined space and the third confined space. The steel wire rope of the hoisting structure hermetically passes through the walking groove, and the lifting appliance of the hoisting structure is placed in each confined space. The first crown block 51 walks to drive the hoisting structure to move in the first confined space, the second confined space and the third confined space, so as to realize the movement of the hoisted workpiece to be processed.

Figure 2:
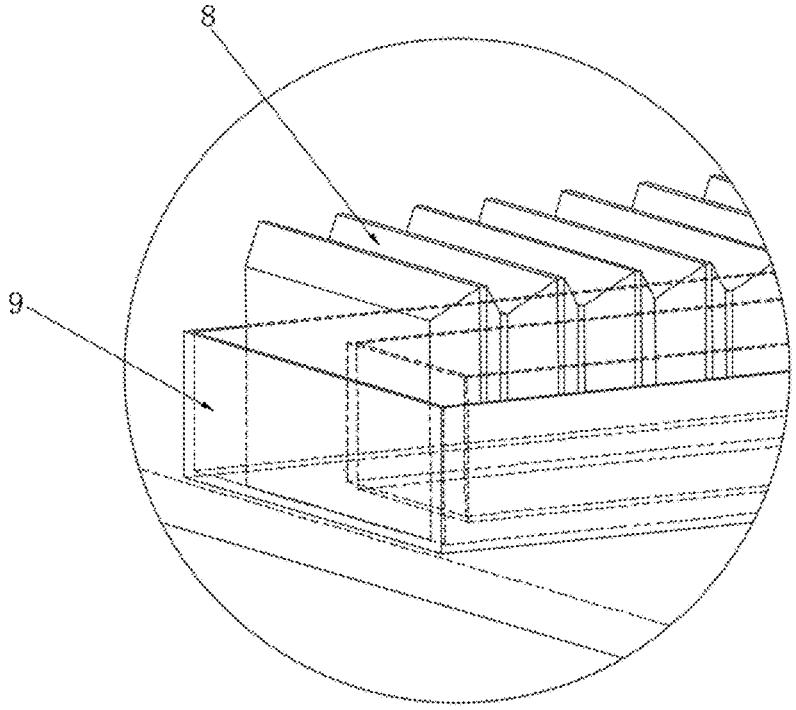
FIG. 2 is a schematic diagram showing the coordination between the organ sealing cover and the oil groove according to the present invention.
Figure 3:
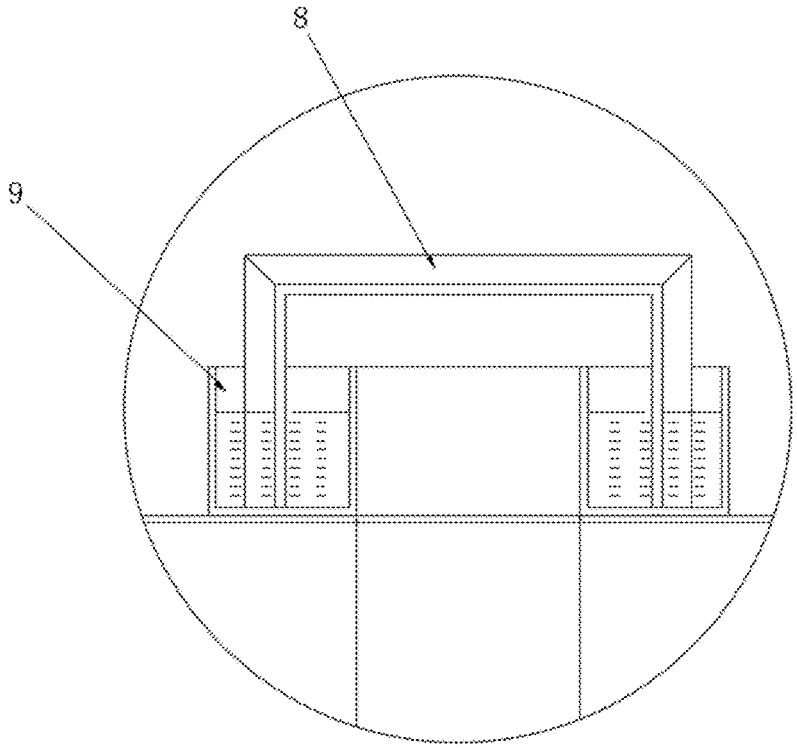
FIG. 3 is a front view showing the coordination between the organ sealing cover and the oil groove according to the present invention.

In this embodiment, the hoisting structure extends into the box body through the organ sealing cover 8. Specifically, as shown in FIG. 2 and FIG. 3, the oil groove 9 is arranged at the periphery of the walking groove, and a liquid (such as water or oil) is placed in the oil groove 9, and the bottom of the organ sealing cover 8 is placed in the oil groove 9 and sealed by the liquid in the oil groove 9.

The steel wire rope of the hoisting structure penetrates through the organ sealing cover 8. Preferably, a steel pipe is vertically arranged at the organ sealing cover 8, the steel wire rope of the hoisting structure penetrates through the steel pipe, and the steel wire rope slides freely in the steel pipe, but cannot rotate freely, so as to ensure that the lifting appliance connected to the steel wire rope accurately connects the lifting ring on the workpiece to be processed. The steel pipe is filled with fire-resistant asbestos, which prevents nitrogen from overflowing inside the box body.

In this embodiment, when the first crown block 51 moves, the steel wire rope drives one side of the organ sealing cover 8 to extend and the other side to contract through the steel pipe. The extension and contraction of the organ sealing cover 8 ensures the sealing of the walking groove when the steel wire rope moves, and also ensures the sealing of the three confined spaces.

In this embodiment, the second crown block 52 and the third crown block 53 are further arranged. The second crown block 52 is arranged at the trolley 10 on one side of the waiting zone 1, which is configured to hoist the workpiece to be processed onto the trolley 10. The third crown block 53 is arranged at the trolley 10 on one side of the post-plating turnover zone 3, which is configured to hoist and transport the workpiece to be processed after hot-dip plating on the trolley 10 to the finished product placing zone.

When the apparatus for environmentally-friendly batch hot-dip coating of high-performance alloy according to this embodiment is used, the following methods are specifically adopted.

First, a pre-treated workpiece to be processed is transported to the trolley 10 on one side of the waiting zone 1 by the second crown block 52, and a pre-treatment includes rust removal and/or water washing.

Subsequently, the linear air knife 7 on the side, adjacent to the trolley 10, of the waiting zone 1 is opened to form a nitrogen gate seal, and then the sealing door 6 (i.e., sliding door) at the side, close to the trolley 10, of the waiting zone 1 is opened. The workpiece to be processed is transported into the waiting zone 1 by the trolley 10, and the workpiece to be processed is hoisted by the hoisting structure of the first crown block 51. Then the trolley 10 exits, and the sealing door 6 and the linear air knife 7 on the side, close to the trolley 10, of the waiting zone 1 are closed in sequence.

Nitrogen fills the first confined space of the waiting zone 1. When the purity of the nitrogen in the waiting zone 1 meets the process requirements, the sealing door 6 (i.e., opening-closing door) shared by the waiting zone 1 and the heating zone 2 is opened, followed by transporting the workpiece to be processed to the heating zone 2 via the first crown block 51. Then the sealing door 6 is closed and the heating device is opened to heat the workpiece to be processed. After heating to the preset temperature according to the process requirements, the workpiece to be processed is driven to directly enter into the zinc pot 4 by the first crown block 51 for hot-dip plating. After the hot-dip plating is completed, the workpiece to be processed after hot-dip plating is hoisted by the first crown block 51 to the heating zone 2 for post-plating cooling. When a larger thickness layer is needed, hot-dip plating may be repeated two or three times.

After that, the linear air knife 7 and the sealing door 6 shared by the heating zone 2 and the post-plating turnover zone 3 on the adjacent sides are opened in sequence. The workpiece to be processed after hot-dip plating is transported to the post-plating turnover zone 3 by the first crown block 51, and placed on the trolley 10 on one side of the post-plating turnover zone 3. The sealing door 6 and the linear air knife 7 shared by the heating zone 2 and the post-plating turnover zone 3 are closed successively.

After that, the linear air knife 7 and the sealing door 6 on the side, close to the trolley 10, of the post-plating turnover zone 3 are opened in sequence. The trolley 10 drives away from the post-plating turnover zone 3 for post-treatment. At the same time, the lifting appliance of the first crown block 51 is detached from the workpiece to be processed after hot-dip plating. After the trolley 10 drives away from the post-plating turnover zone 3, the trolley 10 stops at the exit position and workpiece is hoisted by the third crown block 53 for post-treatment. This completes the whole hot-dip plating process.

In addition, this embodiment also realizes a batch hot-dip coating process, that is, the hot-dip plating operation is performed on a plurality of workpieces to be processed at the same time.

The present invention also provides a method for environmentally-friendly batch hot-dip coating of high-performance alloy, which is applied to the above-mentioned apparatus, and the method includes the following steps.

S10, a pre-treated workpiece to be processed is transported to the waiting zone 1, and the workpiece to be processed is hoisted by the transporting device 5. A pre-treatment includes rust removal and/or water washing.

S20, an inert gas with a preset purity is filled into the waiting zone 1.

S30, the workpiece to be processed is transported to the heating zone 2 by the transporting device 5, and heated to a preset temperature by the heating device in the heating zone 2.

S40, the workpiece to be processed is hoisted into the zinc pot 4 by the transporting device 5 for hot-dip plating with zinc or zinc-based alloy;

S50, the workpiece to be processed after hot-dip plating with zinc or zinc-based alloy is transported to the post-plating turnover zone 3 by the transporting device 5.

The detailed steps of the above-mentioned method have been illustrated in the working process of the apparatus for environmentally-friendly batch hot-dip coating of high-performance alloy, which will not be repeated here.

The following embodiments illustrate the hot-dip plating process of the apparatus for environmentally-friendly batch hot-dip coating of high-performance alloy according to the present invention.

Embodiment 1

A round steel article with a diameter of 10 mm and a length of 100 mm is selected as a workpiece to be processed. The round steel is Q195 material and has a tensile strength of 455 MPa. Galfan alloy is used for hot-dip plating. A alloy coating layer has a thickness of 15-20 μm. The round steel article has a strength decreasing less than 3%. The process is as follows.

After rust removal and water washing, the workpiece to be processed is placed in the waiting zone 1. After the waiting zone 1 and the heating zone 2 are filled with an inert gas, the workpiece to be processed is transferred to the heating zone 2 for heating. After the workpiece to be processed is heated to the process requirements, the workpiece to be processed is directly immersed in the zinc pot 4 to perform a hot-dip plating with the Galfan alloy. Then, the workpiece to be processed is taken out to be air-cooled and water-cooled to complete the Galfan alloy hot-dip plating process without flux. Parameters of the hot-dip plating process are as follows: a heating temperature of 420° C., a heat preservation time of 10 min, a flux temperature of 420° C., a hot-dip plating time of 5 s. The thickness of the coating layer is 20 μm.

Embodiment 2

An angle steel of 50*50*200 mm is subjected to hot-dip plating with zinc by adopting the method of the present invention. The angle steel is Q345 material and has a tensile strength of 450 MPa. Zinc is used for hot-dip plating with a coated zinc content of 420 g/m$^2$ and a plating thickness of 30 μm. The angle steel has a strength decreasing within 3%. The process is as follows.

After rust removal and water washing is performed on the angle steel, the workpiece to be processed is placed in the waiting zone 1. After the waiting zone 1 and the heating zone 2 are filled with an inert gas, the workpiece to be processed is transferred to the heating zone 2 for heating. After the workpiece to be processed is heated to the process requirements, the workpiece to be processed is directly immersed in the zinc pot 4 to perform a hot-dip plating with zinc. Then, the workpiece to be processed is taken out to be air-cooled and water-cooled to complete the zinc hot-dip plating process without flux. Parameters of the hot-dip plating process are as follows: a heating temperature of 500° C., a heat preservation time of 15 min, a zinc bath temperature of 440° C., a hot-dip plating time of 10 s.

Other embodiments of the present invention refer to the following table:

| Coating layer Type | Coating layer Thickness/um | Heating process Temperature * time/min | Hot-dip Plating Process Plating Solution Temperature * Hot-dip Plating Time/s |
|---|---|---|---|
| Zn | 20 | 450 * 10 | 450 * 5 |
| | 85 | 550 * 15 | 450 * 10 |
| | 120 | 600 * 20 | 450 * 30 |
| Galfan | 15 | 400 * 10 | 400 * 3 |
| | 50 | 550 * 15 | 460 * 8 |
| | 100 | 600 * 20 | 500 * 20 |
| Galvalume | 30 | 550 * 10 | 550 * 5 |
| | 80 | 600 * 15 | 600 * 15 |
| | 120 | 700 * 20 | 700 * 25 |
| ZAM Alloy | 10 | 400 * 10 | 400 * 3 |
| Zn—5% Al—3% | 20 | 450 * 15 | 450 * 10 |
| Mg | 85 | 550 * 20 | 550 * 20 |
| Supeckdema | 20 | 400 * 10 | 400 * 5 |
| Alloy | 30 | 450 * 15 | 450 * 10 |
| Zn—10% Al—3% Mg—1% Si | 60 | 550 * 20 | 550 * 20 |

Compared with the traditional method of hot-dip galvanizing, the apparatus and method for environmentally-friendly batch hot-dip coating of high-performance alloy has the following advantages.

1. The problem of zinc smoke pollution caused by the flux used in the flux method is avoided, and the problem of zinc smoke pollution produced during batch hot-dip galvanizing is solved.

2. Strong adaptability: the method of the present invention realizes batch hot-dip coating without the flux. In addition to hot-dip plating with zinc, other zinc-aluminum alloys, such as Galfan, Galvalume, zinc-aluminum-magnesium, magnesium-zinc-silicon, zinc-nickel alloy, etc., can also be hot-dip plated.

3. High production efficiency: since the workpiece to be processed has been heated to a temperature higher than a temperature of the hot-dip plating process before hot-dip plating, the heating temperature of the workpiece to be processed is equal to the temperature of the hot-dip plating process, so as to ensure the energy balance of the system. The hot-dip plating temperature is 20-50° C. higher than the melting point of alloy for hot-dip plating. For example, the minimum temperature of hot-dip plating Galfan alloy is 400° C., which can maintain the mechanical strength of the workpiece to be processed at the maximum degree. Because the workpiece to be processed has been heated before entering the zinc pot 4, there is no need for heating up time in the zinc pot 4, and the workpiece to be processed directly reacts with the flux to complete the hot-dip plating. Therefore, the hot-dip plating time is very short, which can significantly improve the production efficiency.

4. Low production cost:

(1) energy saving: the traditional zinc pot 4 must be 20-40 times larger than the mass of the workpiece to be processed because the traditional zinc pot 4 is configured for heating the workpiece to be processed. The zinc content is at least dozens of tons, generally 40-60 tons. However, since the workpiece to be processed is heated to a temperature higher than the hot-dip plating temperature in advance, the zinc pot 4 is only used to accommodate the hot-dip plating materials, and does not need to further heat the flux. The zinc pot 4 can be small enough as long as it can accommodate the workpiece. Therefore, the zinc pot 4 has the advantages of small volume, small zinc content, low power, more energy saving and material saving. In addition, the zinc pot 4 works in a confined system, which reduces the energy loss of the zinc surface, so the energy saving is remarkable, and the energy saving is more than 30%.

(2) plating materials saving: there is no zinc ash because there is no flux and hot-dip galvanizing is performed in a confine system. Due to the short residence time of the workpiece to be processed in the zinc pot 4, there is less zinc dross. These two items saves more than 10% of zinc.

(3) As there is no flux, the cost of the flux itself is saved, which is about 20 yuan per ton of workpiece.

5. High production quality: because there is no zinc ash floating on the surface of zinc bath, there is no zinc ash pollution occurring on the surface of the coating layer. Due to the small amount of zinc dross, the flux has good fluidity, and the coating layer has good uniformity and is smoother and cleaner.

It should be noted that, when the embodiment is performed for small batch production, the waiting zone 1 and the post-plating turnover zone 3 may not be arranged, and the workpiece to be processed is directly heated in the heating zone 2 and subjected to hot-dip plating with zinc or zinc-based alloy in the zinc pot 4.

It will be apparent that the above-described embodiments of the present invention are merely illustrative of the present invention and are not intended to limit the embodiments of the present invention. It will be apparent to those skilled in the art that various obvious changes, modifications and substitutions can be made without departing from the scope of the present invention. It is not necessary and impossible to be exhaustive of all embodiments herein. Any modifications, equivalents, and alternatives made within the spirits and principles of the present invention shall fall within the scope of protection of claims of the present invention.

What is claimed is:

1. A method for an environmentally-friendly batch hot-dip coating of an alloy, wherein the method is applied to an apparatus for the environmentally-friendly batch hot-dip coating, and the method comprises:

transporting a pre-treated workpiece to be processed to a waiting zone, and hoisting the pre-treated workpiece to be processed through a transporting device, wherein a pre-treatment comprises a rust removal and/or a water washing;

filling an inert gas with a purity into the waiting zone;

transporting the pre-treated workpiece to be processed to a heating zone by the transporting device, and heating the pre-treated workpiece to be processed to a temperature of 400-700° C. by a heating device in the heating zone;

hoisting the pre-treated workpiece to be processed into a zinc pot by the transporting device for a hot-dip plating with zinc or zinc-based alloys;

transporting the pre-treated workpiece to be processed after the hot-dip plating with the zinc or the zinc-based alloys to a post-plating turnover zone by the transporting device, wherein the apparatus further comprises a box body, wherein the box body forms the waiting zone, the heating zone and the post-plating turnover zone successively, and the waiting zone, the heating zone and the post-plating turnover zone are formed along a length direction of the box body; or the box body forms the waiting zone and the heating zone successively, and the waiting zone and the heating zone are formed along a length direction of the box body, and wherein the transporting device comprises a first crown block, the first crown block is arranged above the box body, and a hoisting structure of the first crown block hermetically extends into the box body for hoisting and transporting the workpiece to be processed.

2. The method according to claim 1, wherein a first sealing door is arranged between the waiting zone and the heating zone, and a second sealing door is arranged between the heating zone and the post-plating turnover zone; if there is not the post-plating turnover zone, the second sealing door is omitted.

3. The method according to claim 2, wherein at least one side of each of the first sealing door and the second sealing door is provided with a linear air knife, and the linear air knife is configured to form a nitrogen curtain before the first sealing door or the second sealing door is opened to seal the side of the first sealing door or the side of the second sealing door.

4. The method according to claim 1, wherein a top of the box body is provided with a walking groove, the walking groove is arranged along the length direction of the box body, the walking groove covers the first confined space, the second confined space and the third confined space, and the hoisting structure of the first crown block hermetically extends into the box body through the walking groove.

5. The method according to claim 4, wherein the apparatus further comprises an organ sealing cover, wherein the organ sealing cover hermetically covers on the walking groove, the hoisting structure of the first crown block hermetically passes through the organ sealing cover and the hoisting structure of the first crown block is placed in the box body, and the first crown block moves to drive the organ sealing cover to extend and shrink.

6. The method according to claim 5, wherein an oil groove is arranged at a peripheral of the walking groove, and a bottom of the organ sealing cover is placed in the oil groove and the bottom of the organ sealing cover is sealed by a liquid, wherein the liquid is in the oil groove.

7. The method according to claim 1, wherein the heating device is arranged on an inner wall of the heating zone, and the heating device is located above the zinc pot.

* * * * *